US011577945B2

(12) United States Patent
Myrland

(10) Patent No.: US 11,577,945 B2
(45) **Date of Patent: *Feb. 14, 2023**

(54) CABLE TENSION OVERLOAD FUSE ASSEMBLY

(71) Applicant: Beacon Athletics, LLC, Middleton, WI (US)

(72) Inventor: James W. Myrland, Belleville, WI (US)

(73) Assignee: Beacon Athletics, LLC, Middleton, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/824,666

(22) Filed: May 25, 2022

(65) Prior Publication Data

US 2022/0289535 A1 Sep. 15, 2022

Related U.S. Application Data

(63) Continuation of application No. 16/382,701, filed on Apr. 12, 2019, now Pat. No. 11,352,241.

(60) Provisional application No. 62/656,779, filed on Apr. 12, 2018.

(51) Int. Cl.
*B66D 1/50* (2006.01)
*B66D 1/58* (2006.01)

(52) U.S. Cl.
CPC ..... *B66D 1/58* (2013.01)

(58) Field of Classification Search
CPC ..... B66D 1/58; A63B 71/021; A63B 71/022
See application file for complete search history.

(56) References Cited

U.S. PATENT DOCUMENTS

| | | | | |
|---|---|---|---|---|
| 4,446,944 | A | 5/1984 | Forrest et al. | |
| 5,113,981 | A | 5/1992 | Lantz | |
| 5,975,498 | A | 11/1999 | Sauner | |
| 6,406,000 | B1 | 6/2002 | Raz et al. | |
| 6,435,479 | B1 | 8/2002 | Raz et al. | |
| 7,650,717 | B2 | 1/2010 | Drayer | |
| 8,109,419 | B2 | 2/2012 | Khavronine | |
| 9,498,659 | B2 | 11/2016 | Schurian | |
| 2021/0283486 | A1* | 9/2021 | Engel | A63B 69/3691 |

* cited by examiner

*Primary Examiner* — Emmanuel M Marcelo
(74) *Attorney, Agent, or Firm* — Michael Best & Friedrich LLP

(57) ABSTRACT

A fuse link that having a body including a rigid member, a first end, and a second end opposite the first end. A reduced material portion of the body is positioned between the first and second ends, the reduced material portion is configured to fail in response to a predetermined load.

20 Claims, 6 Drawing Sheets

CABLE TENSION OVERLOAD FUSE ASSEMBLY

CROSS-REFERENCE TO RELATED APPLICATIONS

This application is a continuation of U.S. patent application Ser. No. 16/382,701, filed on Apr. 12, 2019 and entitled "CABLE TENSION OVERLOAD FUSE ASSEMBLY," which claims priority to U.S. Provisional Application No. 62/656,779 filed Apr. 12, 2018, entitled "CABLE TENSION OVERLOAD FUSE ASSEMBLY," the contents of which are hereby incorporated by reference in their entirety.

FIELD

The present inventions relate to the field of supported distributed loads and the protection and safety of components and surroundings thereof. The present inventions more specifically relate to the field of protection and safety for sports netting and cable and structural supports thereof.

BACKGROUND

Sports barrier netting installations are becoming increasingly popular at sports facilities. For example, barrier netting can be found throughout many baseball fields and field complexes as foul ball barriers, backstops, and other protective screens to prevent player and spectator injury, prevent property damage, help retain balls in the field of play, etc. Barrier netting can also be found in batting cages. In addition, barrier netting can be found in other types of facilities, including soccer and tennis complexes, golf complexes (e.g., around driving ranges) and at a variety of other multi-sports complexes and arenas.

In these various complexes, a common netting configuration includes barrier netting or fabric supported by a barrier cable in tension between support cables operatively coupled to structural supports. When a barrier cable extends between two support structures to support a barrier net or fabric panel, a force is transmitted to the support cables and structural supports as a function of the distributed load applied to the barrier cable and the geometry that defines the curve (sag) of the cable. Optimally, the barrier cable is tensioned so that the static sag in the barrier cable and netting system is minimized. When a barrier cable is used to support a barrier net or fabric panel, the weight of the net or fabric represents a distributed load under static conditions.

When that net or fabric panel resists an increased or more dynamic load (e.g., due to wind and/or snow loading), the distributed load held by the barrier cable, which was previously tensioned in the static condition to minimize sag, is transmitted (e.g., through one or more support cables) to one or more structural supports.

This transmitted load and forces can be problematic from both a structural integrity and structural design perspective. For example, the anticipated and potential forces on the structural supports can damage the supports or cause them to fail. If the structure supports are not sufficiently designed, the forces transmitted to those supports can damage those supports.

To prevent such damage or failing, the structural supports may be designed to be more robust, larger, wider, thicker, or otherwise stronger, to support potential load without damage and/or failing. However, more robust supports typically cost significantly more than less robust supports.

To prevent damage to the supports while allowing a less robust, less costly support structure to be used in the design, it is known to include a mechanical fuse link between the barrier cable supporting the barrier net or fabric and the support cable operatively coupled to the support structure. These fuse links are designed to shear or break before the forces cause damage to the structural supports. When they break, however, the barrier net and/or barrier cable typically falls to the ground, leading to damage and safety issues and concerns. The damage can be to the net, to the cable, or to other objects or persons below. In addition, when the mechanical link breaks, the end of the support cable previously coupled through the link to the barrier cable is often left remaining near the top of the structural support. To replace the mechanical link and otherwise repair or reset the net barrier, a repair person must retrieve the end of the cable left at the top of the support structure. This can delay repair of the net barrier and also creates its own potential safety issues for the repair person in retrieving the end of the cable.

SUMMARY

There is, therefore, a need for an improved cable tension overload fuse assembly. Accordingly, an improved cable tension overload fuse assembly is provided.

As disclosed in more detail herein, a barrier net and barrier cable does not need to completely detach from the support cable, or from the structural support itself. Rather, an increase in the amount of sag in the barrier cable can sufficiently lower or reduce forces or loads otherwise transmitted to a structural support. The increase in the amount of sag in the barrier cable will result in a relatively lower transmitted force to the structural supports for a given distributed load.

To avoid a complete break between the structural support and/or support cable and the barrier cable holding or retaining the net or fabric panel barrier, the present disclosure includes a rescue cable extending between the structural cable and the barrier cable retaining the net or fabric panel. When the mechanical link between the cables shears, the rescue cable, which is longer than the length of an intact mechanical fuse, adds length to the existing support cable and/or barrier cable to allow the barrier cable to sag to reduce the load otherwise transmitted to the structural support. As a result, the structural support is better protected from damage or failing, and can be designed accordingly (e.g., with less robust features and costs). In addition, the rescue cable helps maintain a physical or operative connection between the barrier cable and support cable to prevent the barrier cable and barrier or net from dropping uncontrolled to the ground and damaging itself as a result, or property or persons in the vicinity below. The maintained connection also allows the end of the support cable coupled to a part of the broken mechanical fuse to be lowered together with the other portion of the fuse, barrier cable and barrier netting for repairs, resetting, etc.

Accordingly, one aspect of the present disclosure provides for a cable tension overload fuse assembly, the cable tension overload fuse assembly comprising: a mechanical fuse link coupled between a net barrier cable and a structural support cable, the mechanical fuse link helping to retain the net barrier cable in a first position relative to a structural support; and a rescue cable coupled between the net barrier cable and the structural support cable; whereby the mechanical fuse link is configured to break, snap, shear or otherwise fail when a tension load from the net barrier cable and/or the structural support cable exceeds a predetermined tension load; and whereby the rescue cable allows the net barrier cable to sag or move from the first position relative to the structural support after the mechanical fuse link fails to reduce the tension load while the rescue cable maintains a physical connection between the net barrier cable and the structural support cable.

Accordingly, one aspect of the present disclosure provides for a cable tension overload fuse assembly comprising: a mechanical fuse link having first and second opposing ends; and a rescue cable having first and second opposing ends; whereby the first opposing end of the mechanical fuse link is adapted to be coupled to a first end of structural support cable operatively coupled to a structural support for a netting system and the second opposing end of the mechanical fuse link is adapted to be coupled to a net barrier cable helping support a net of the netting system; whereby the first opposing end of the rescue cable is adapted to be coupled to the first end of the structural support cable and the second opposing end of the rescue cable is adapted to be coupled to the net barrier cable; and whereby the mechanical fuse link is adapted to break, snap, shear or otherwise fail before any of the rescue cable, the structural support cable, and the net barrier cable breaks, snaps, shears or otherwise fails.

Accordingly, one aspect of the present disclosure provides for a cable tension overload fuse assembly comprising: a mechanical fuse link having first and second opposing ends spaced from each other by a reduced material portion adapted to fail at a predetermined design load; a rescue cable having first and second opposing ends; whereby the first ends of the mechanical fuse link and the rescue cable are coupled to a first shackle and the second ends of the mechanical fuse link and the rescue cable are coupled to a second shackle.

BRIEF DESCRIPTION OF DRAWINGS

Various examples of embodiments of the systems, devices, and methods according to this invention will be described in detail, with reference to the following figures, wherein.

It should be understood that the drawings are not necessarily to scale. In certain instances, details that are not necessary to the understanding of the invention or render other details difficult to perceive may have been omitted. It should be understood, of course, that the invention is not necessarily limited to the particular embodiments illustrated herein.

DETAILED DESCRIPTION

Referring to the Figures, an improved barrier net and cable system, an improved cable tension overload fuse assembly, and method for using same are provided herein.

Figure 1:
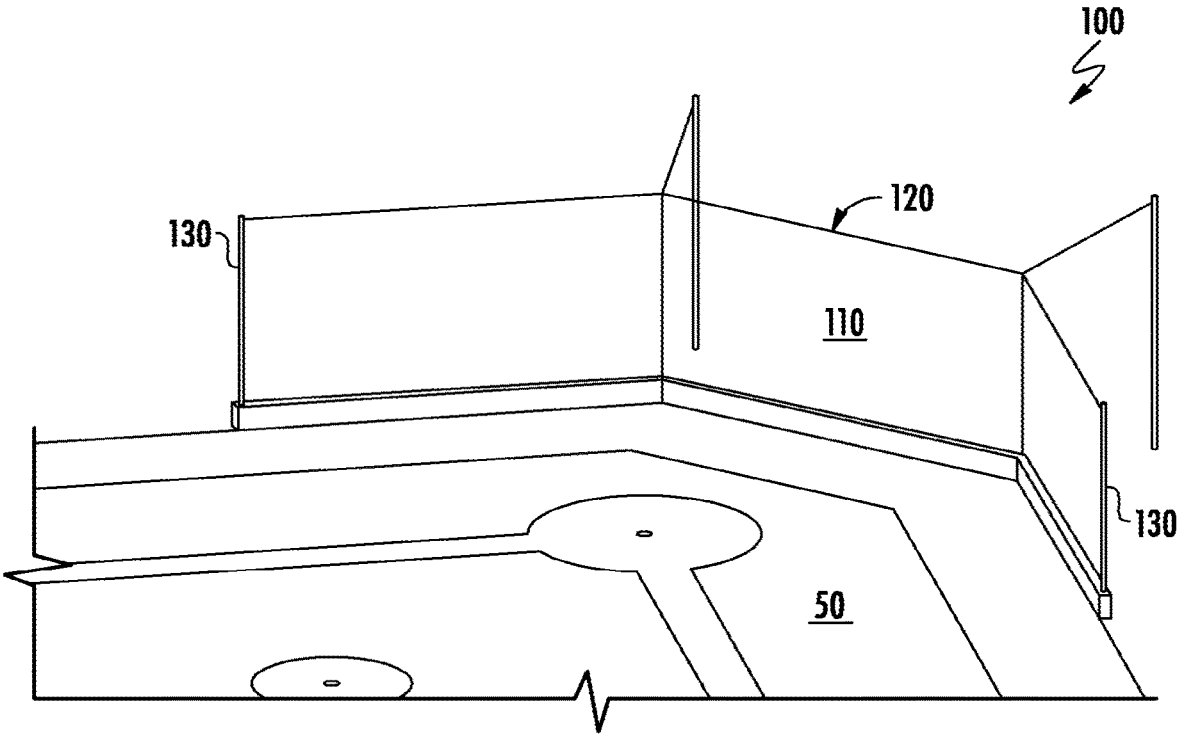
FIG. 1 illustrates a perspective view of a barrier netting system serving as a backstop at a baseball field, according to various examples of embodiments.
Figure 2:
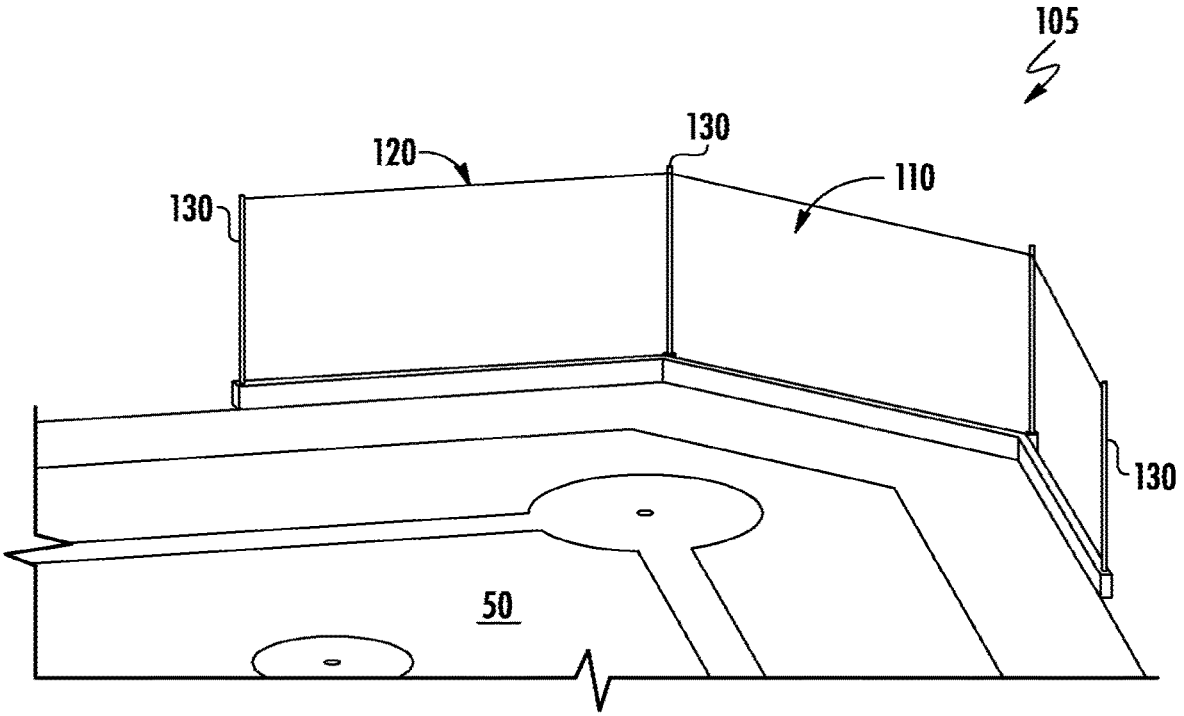
FIG. 2 illustrates a perspective view of a barrier netting system serving as a backstop at a baseball field, according to various examples of embodiments.

Referring now to FIGS. 1 and 2, in various embodiments, a barrier or netting and cable system or configuration 100/105 (e.g., for a sports field 50) includes a barrier netting or fabric panel 110 supported by a barrier cable 120 in tension between support cables (not shown) operatively coupled to structural supports 130. While sports field 50 is illustrated as a baseball diamond or complex, it should be appreciated that the sports field may be any kind of sports field or complex utilizing a netting system or barrier, including a soccer field or complex, a tennis court or complex, a golf complex (e.g., a driving range), etc. In addition, while system 100/110 is illustrated as a backstop, the system could be a foul ball barrier, batting cage barrier, and/or any system of barrier netting or fabric for protecting and preventing injury or damage.

When barrier cable 120 extends between two structural supports 130 to support barrier netting or fabric panel 110, a force or load is transmitted to the support cables and structural supports 130 as a function of a distributed load applied to barrier cable 120 and the geometry that defines a curve or sag of barrier cable 120. As illustrated, in various embodiments, barrier cable 120 is tensioned so that the static sag or curve in barrier cable 120 and netting system 100 is minimized. When barrier cable 120 is used to support barrier net or fabric panel 110, the weight of net or fabric 110 represents a distributed load under static conditions. When netting or fabric panel 110 resists an increased or more dynamic load (e.g., due to wind and/or snow loading), the distributed load held by barrier cable 120, which was previously tensioned in a static condition to minimize sag in barrier cable 120, is transmitted (e.g., through the one or more support cables) to one or more structural supports 130.

Figure 3:
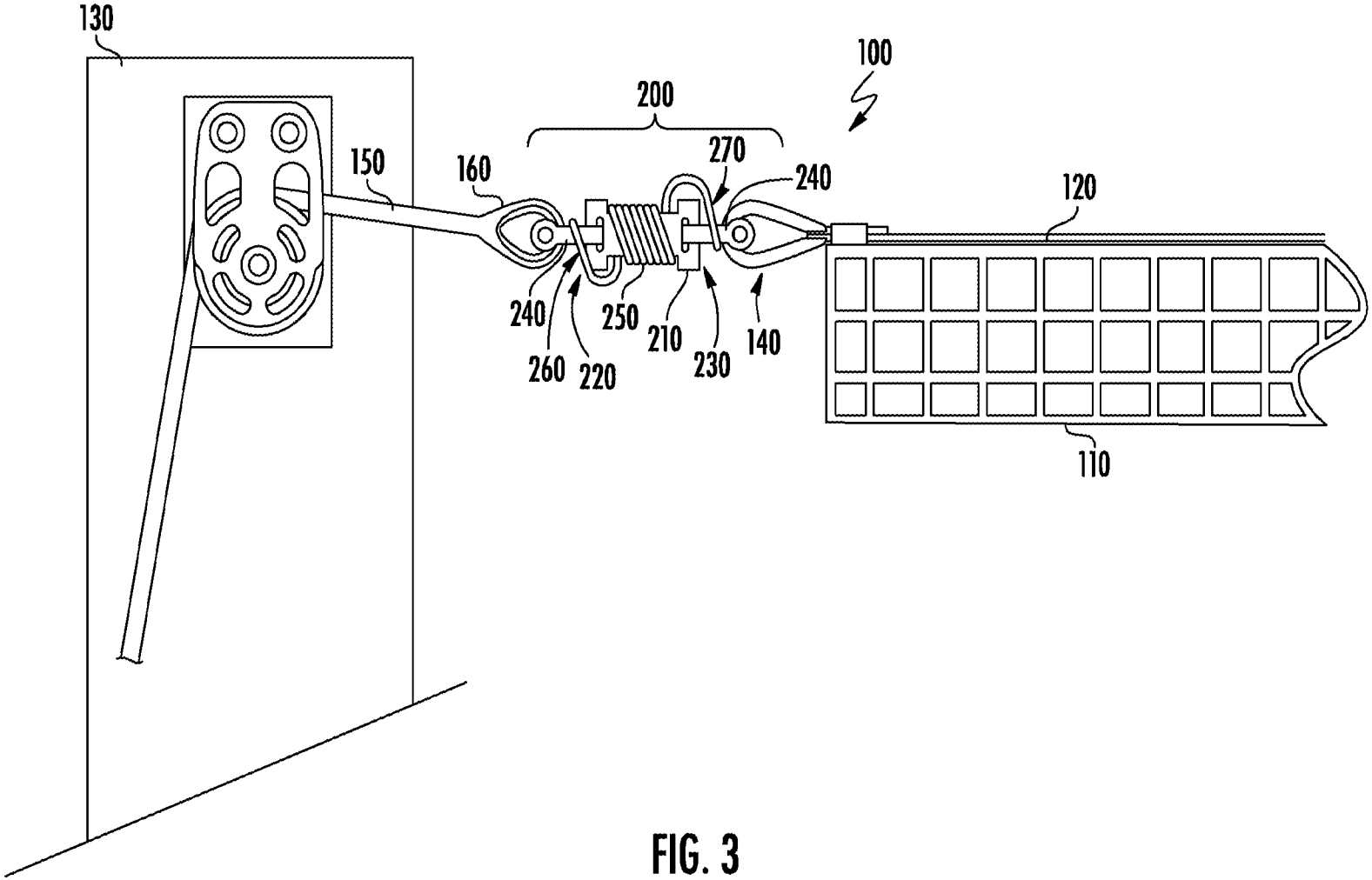
FIG. 3 illustrates a side view of an intact cable tension overload fuse apparatus, according to various examples of embodiments, coupled between a barrier cable coupled to a fabric panel and a support cable and/or tensioning halyard.
Figure 4:
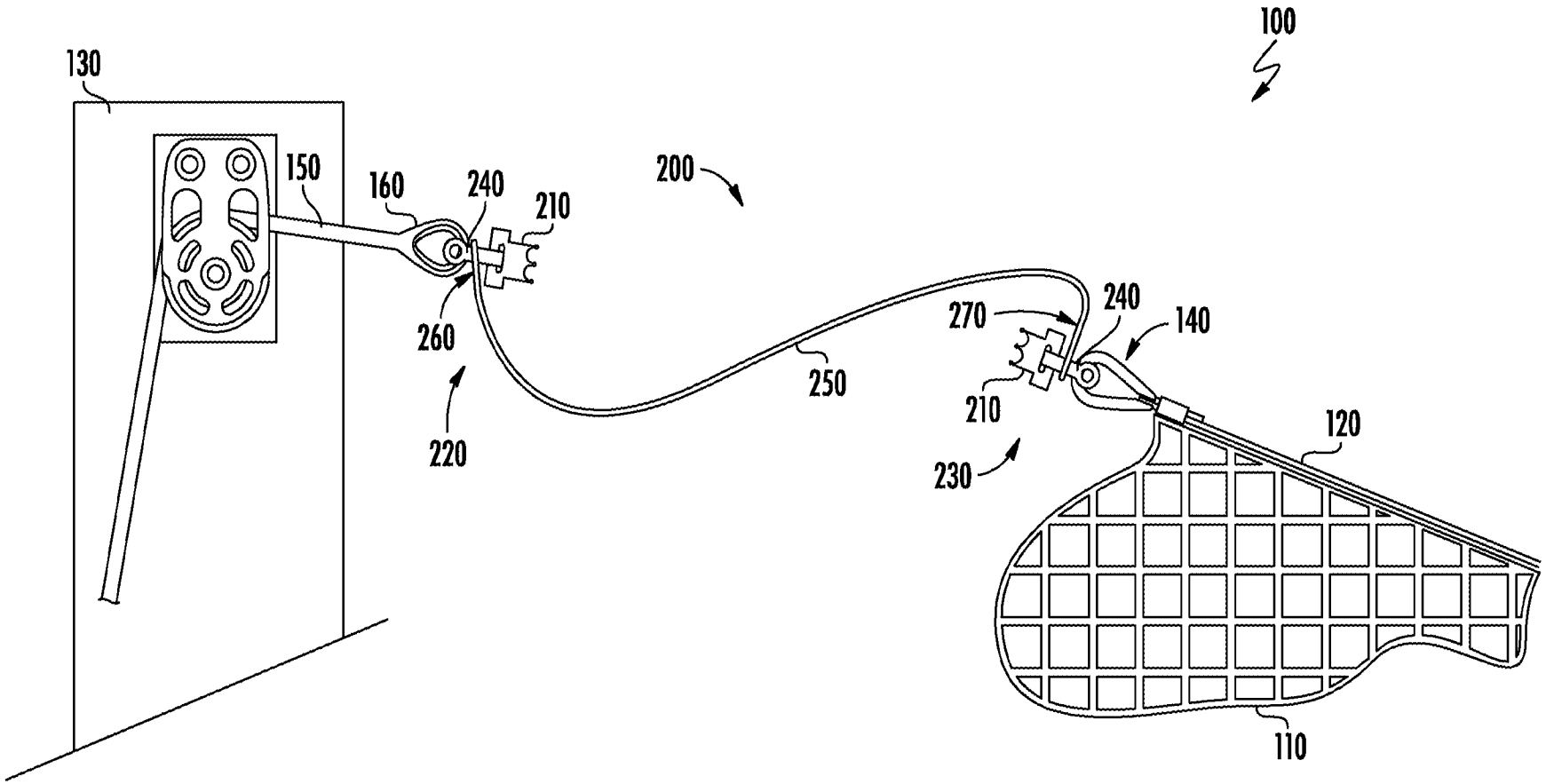
FIG. 4 illustrates a side view of an open cable tension overload fuse apparatus, according to various examples of embodiments, extending between a barrier cable coupled to a fabric panel and a support cable and/or tensioning halyard.

Referring now to FIGS. 3 and 4, in various embodiments, barrier net and cable system 100 includes barrier cable 120 for supporting barrier net or fabric 110, barrier cable 120 having opposing ends (one opposing end 140 shown in FIGS. 3 and 4). In various embodiments, at least one opposing end (e.g., opposing end 140) is coupled to an overload fuse assembly 200. In various embodiments, barrier net and cable system 100 also includes support cable 150 coupled to overload fuse assembly 200 and coupled or operatively coupled to structural support 130.

In various embodiments, cable tension overload fuse assembly 200 includes a fuse link (e.g., mechanical fuse link) 210 having opposing ends 220/230. In various embodiments, at least one opposing end 220/230 of fuse link 210 is coupled to a first shackle or link 240. In various embodiments, a first shackle 240 is coupled to structural support cable 150 (and/or a halyard (e.g., tensioning halyard) 160 coupled to structural support cable 150 and a second shackle 240 is coupled to barrier cable 120 retaining net or barrier 110. In various embodiments, overload fuse assembly 200 also includes a rescue cable 250 having opposing ends 260 and 270, coupled at a first opposing end to shackle 240 and at a second opposing end to a second shackle 240.

Figure 6:
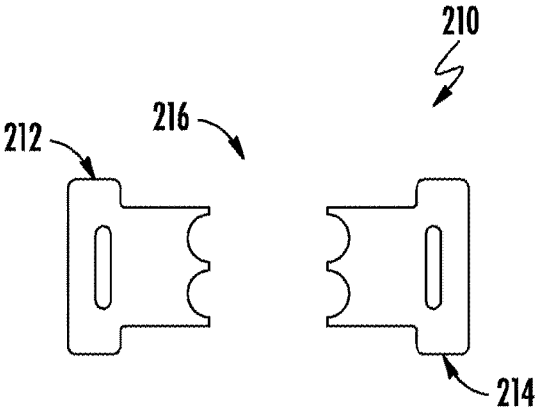
FIG. 6 illustrates a perspective view of an open or failed mechanical fuse link, according to various examples of embodiments.
Figure 5:
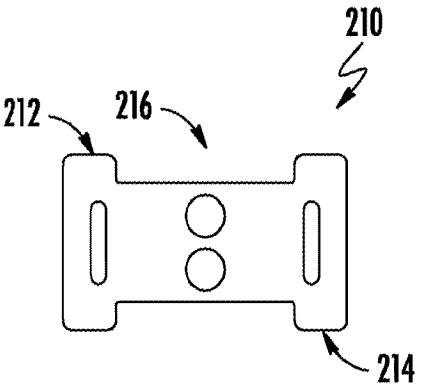
FIG. 5 illustrates a perspective view of an intact mechanical fuse link, according to various examples of embodiments.

As will appreciated, several variations of a fuse or fuse link may be utilized within the scope of the disclosure herein. An example fuse link 210 is shown in more detail in FIGS. 5-6 and includes a machined length of material having a first end 212 and a second end 214 spaced from each other by a reduced material portion 216 which is designed to fail at a predetermined design load. It will be understood that the fuse link 210 is under a tension load during application of a load to a barrier cable and that, in various embodiments, the cross-sectional area, width or dimension of the reduced material portion 216 is determinative of the tension load which can be sustained before the fuse link will break, snap, shear or otherwise fail as illustrated more specifically in FIG. 6. For example, as illustrated, one or more apertures (e.g., side-by-side apertures) are defined and/or sized to reduce the amount of material that is required to fail in tension, and this reduced material helps establish the failure tension of fuse link 210.

In various embodiments, rescue cable 250 is a braided cable or wire rope. The rescue cable may be made using a fiber cable such as Dyneema line or Tenex line. However, the rescue cable may be any cable, rope, strap, wire, chain, cord, line, tether, extension, etc. In various embodiments, fuse link 210, rescue cable 150 and/or any shackles 240 are made from Aluminum or other material (and/or combinations of materials) strong enough to handle the loads and stresses as designed but sufficiently corrosion resistant to avoid undesired failure or damage due, for example, to elements, sun, moisture, etc. (e.g., steel or stainless steel).

Figure 7:
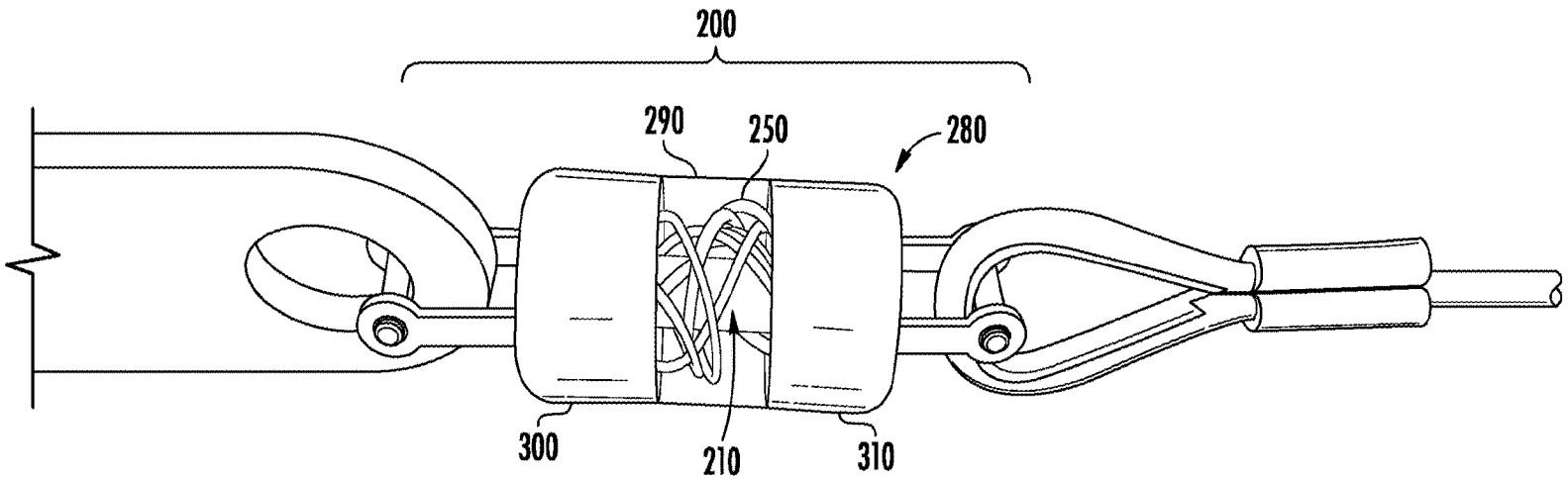
FIG. 7 illustrates a perspective view of an intact apparatus, according to various examples of embodiments, coupled between a barrier cable and a tensioning halyard.
Figure 8:
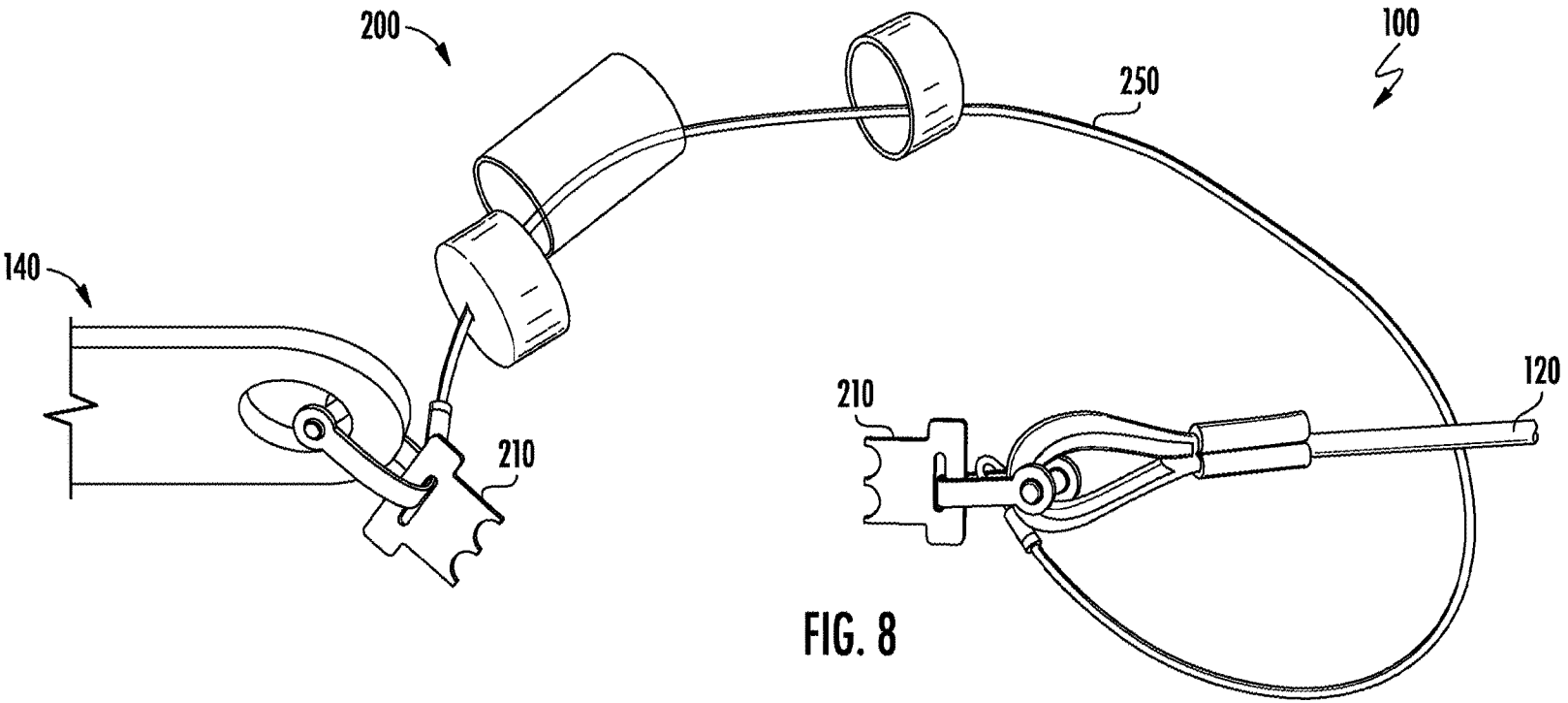
FIG. 8 illustrates a perspective view of an open cable tension overload fuse apparatus coupled between a barrier cable and a tensioning halyard, according to various examples of embodiments.
Figure 9:
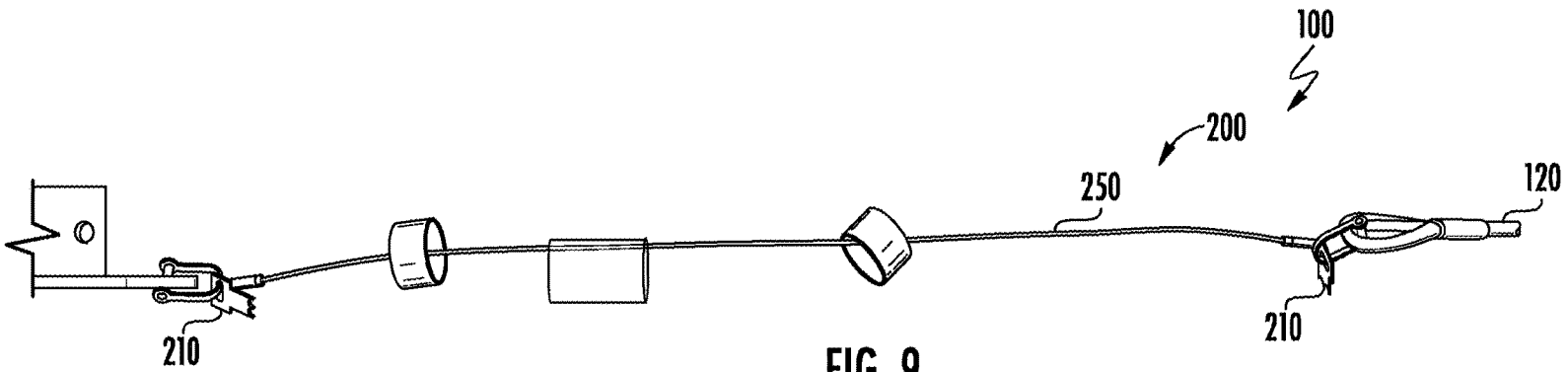
FIG. 9 illustrates a perspective view of an open cable tension overload fuse apparatus coupled between a barrier cable and a tensioning halyard, according to various examples of embodiments.

As more specifically illustrated in FIGS. 7-9, in various embodiments, fuse assembly 200 also includes an enclosure or housing 280. In various examples of embodiments, enclosure 280 includes a tube 290 and end members 300/310 to retain and/or help protect fuse link 210 and/or rescue cable 250 from elements, environment, and/or other conditions that may corrode or otherwise damage or reduce the desired integrity of fuse link 210 and/or rescue cable 250 (e.g., when the fuse link 210 is intact).

It should be appreciated that overload fuse assembly 200 need not include any shackles. In various embodiments, the rescue cable may be coupled directly to the mechanical link and/or the structural support cable (or a halyard therefor (e.g., a halyard provided at an end of the structural support cable)) and barrier cable (or a halyard therefor). For example, the overload fuse assembly may include a mechanical fuse link having opposing ends, wherein one opposing end is coupled to the structural support cable (or a halyard therefor) and the other opposing end is coupled to the net barrier cable (or a halyard therefor). In various embodiments, cable tension overload fuse assembly 200 is coupled to structural support cable 150 and net barrier cable 120. Fuse link 210 of assembly 200 is designed or adapted to remain intact under conditions in a certain range of tension loads. In various embodiments, rescue cable 150 has a length that is longer than a length of mechanical fuse link 210, when intact (e.g., before fuse link 210 breaks, snaps, shears, or otherwise fails).

Should the tension loads exceed or surpass the tension rating or design load of mechanical fuse link 210, fuse link 210 is designed, adapted or configured to break, snap, shear, or otherwise fail. Referring now to FIGS. 8-9, following the break, snap, shear or failure of mechanical fuse link 210, net barrier cable 120 is allowed to sag but does not completely disconnect or uncouple from structural support cable 150 as a connection is maintained by rescue cable 250. Added and/or extra length of rescue cable 250 (e.g., relative to an intact fuse 210) increases the sag in net barrier cable 120 to help reduce the load transmitted to structural support cable 150 and structural support 130. The net barrier and net barrier cable 120 may then be lowered to the ground under control using structural support cable 150 and cable tension overload fuse assembly 200 and any other components of net barrier system 100 can be lowered together and repaired (e.g., on the ground).

Figure 10:
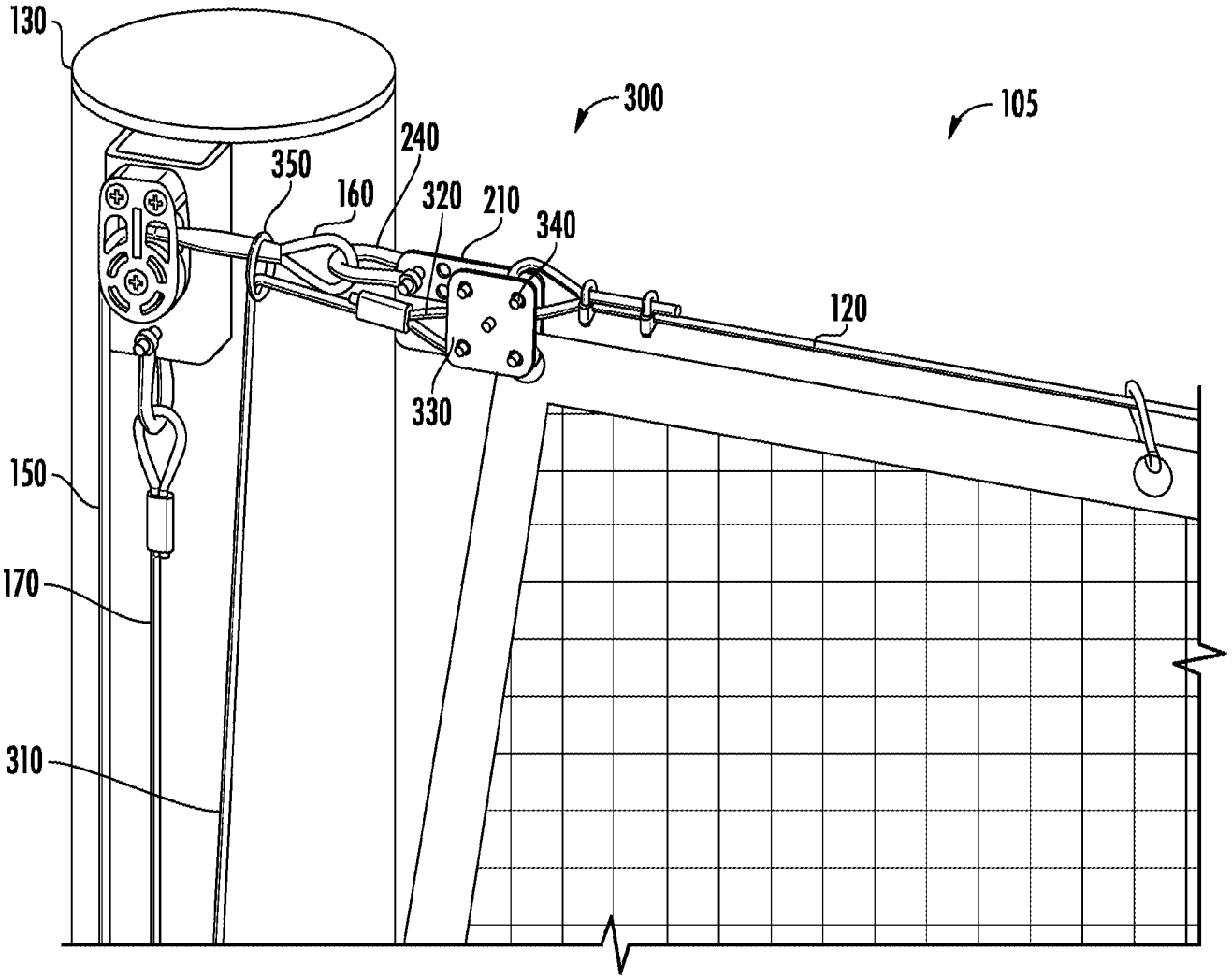
FIG. 10 illustrates a perspective view of an intact cable tension overload fuse apparatus, according to various examples of embodiments, coupled between a barrier cable and a support cable and/or tensioning halyard.

Referring now to FIG. 10, a fuse assembly 300 according to other examples of embodiments (e.g., in an in-line net system 105) is illustrated. In various examples of embodiments, fuse assembly 300 includes a transfer cable 310 having a length running between a first opposing end 320 and a second opposing end (not shown), first opposing end 320 being coupled or attached to a support pole side 330 of a manifold plate assembly 340 coupled to and/or between fuse link 210 and net barrier cable 120, and the second opposing end including a halyard slidably engaged with a cable (e.g., a vertical cable) 170 coupled to structural support 130. In various embodiments, transfer cable 310 is moveably or slidably tethered to support cable 150. In various embodiments, transfer cable 310 runs through a ring 350 provided around and/or near an end of support cable 150 (or halyard 160), which end support cable 150 is coupled to fuse link 210, or shackle 240 coupled to fuse link 210.

In various embodiments, transfer cable 310 is a braided cable or wire rope. The transfer cable may be made using a fiber cable such as Dyneema line or Tenex line. However, the transfer cable may be any cable, rope, strap, wire, chain, cord, line, tether, extension, etc. In various embodiments, transfer cable 310, manifold plate assembly 340, and/or ring 350 are made from Aluminum or other material (and/or combinations of materials) strong enough to handle the loads and stresses as designed but sufficiently corrosion resistant to avoid undesired failure or damage due, for example, to elements, sun, moisture, etc. (e.g., steel or stainless steel).

In various examples of embodiments, length of transfer cable 310 is approximately forty inches. It should be appreciated, however, that transfer cable may be of any length that provides the desired reduction in load transmitted to support structure.

It should be appreciated that manifold plate assembly 340 is not required and that other members, such as a ring or carabineer, that may be simultaneously coupled to barrier cable 120, fuse link 210, and transfer cable 310, may be utilized. It should also be appreciated that cable or vertical cable 170 is not required and other members (e.g., a rail or other feature to which transfer cable 310 may be slidably engaged) may be utilized.

In various embodiments, cable tension overload fuse assembly 300 is coupled to structural support cable 150 and net barrier cable 120. Fuse link 210 of assembly 300 is designed or adapted to remain intact under conditions in a certain range of tension loads. Should the tension loads exceed or surpass the tension rating or design load of mechanical fuse link 210, fuse link 210 is designed, adapted or configured to break, snap, shear, or otherwise fail.

After failure of fuse link 210, in various embodiments, transfer cable 310 remains coupled or connected manifold plate assembly 340. When fuse link 210 fails, tension from barrier cable 120 pulls at least a portion of transfer cable 310 through ring 350 and some or all of the length of transfer cable 310 is effectively added to a total barrier cable length as the second end of transfer cable end slides or moves up vertical cable 170. This extra length allows more sag in barrier cable 120 and a desired reduction in load transmitted to support structure 130. The net barrier and net barrier cable 120 may then be lowered to the ground under control using structural support cable 150, and cable tension overload fuse assembly 300 and any other components of net barrier system 105 may be lowered together and repaired (e.g., on the ground).

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that references to relative positions (e.g., "top" and "bottom") in this description are merely used to identify various elements as are oriented in the Figures. It should be recognized that the orientation of particular components may vary greatly depending on the application in which they are used.

For the purpose of this disclosure, the term "coupled" means the joining of two members directly or indirectly to one another. Such joining may be stationary in nature or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It is also important to note that the construction and arrangement of the system, methods, and devices as shown in the various examples of embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements show as multiple parts may be integrally formed, the operation of the interfaces may be reversed or otherwise varied, the length or width of the structures and/or members or connector or other elements of the system may be varied, the nature or number of adjustment positions provided between the elements may be varied (e.g., by variations in the number of engagement slots or size of the engagement slots or type of engagement). The order or sequence of any process or method steps may be varied or re-sequenced according to alternative embodiments. Other substitutions, modifications, changes and omissions may be made in the design, operating conditions and arrangement of the various examples of embodiments without departing from the spirit or scope of the present inventions.

While this invention has been described in conjunction with the examples of embodiments outlined above, various alternatives, modifications, variations, improvements and/or substantial equivalents, whether known or that are or may be presently foreseen, may become apparent to those having at least ordinary skill in the art. Accordingly, the examples of embodiments of the invention, as set forth above, are intended to be illustrative, not limiting. Various changes may be made without departing from the spirit or scope of the invention. Therefore, the invention is intended to embrace all known or earlier developed alternatives, modifications, variations, improvements and/or substantial equivalents.

What is claimed is:

1. A fuse link comprising:

a body including a rigid member, a first end, and a second end opposite the first end; and a reduced material portion of the body positioned between the first and second ends, the reduced material portion configured to fail in response to a predetermined load.

2. The fuse link of claim 1, further comprising:

a first aperture defined by the body proximate the first end; and a second aperture defined by the body proximate the second end.

3. The fuse link of claim 2, wherein the first aperture is configured to receive a first shackle, the second aperture is configured to receive a second shackle.

4. The fuse link of claim 3, further comprising a rescue cable having a first end in communication with the first shackle, and a second end in communication with the second shackle.

5. The fuse link of claim 3, wherein the first and second shackles cooperate to apply a first load to the body.

6. The fuse link of claim 5, wherein in response to the first load exceeding the predetermined load, the reduced material portion is configured to fail.

7. The fuse link of claim 1, wherein the reduced material portion is defined by at least one aperture.

8. The fuse link of claim 1, wherein the reduced material portion is a plurality of apertures defined by the body.

9. The fuse link of claim 1, wherein the first end is in communication with a structural support member, and the second end is in communication with a net.

10. A tension overload assembly comprising:

a mechanical fuse link including a first end and a second end; and a reduced material portion spacing the first end from the second end, the reduced material portion defined by at least one aperture, wherein the reduced material portion is configured to fail at a predetermined design load.

11. The tension overload assembly of claim 10, wherein the reduced material portion includes a plurality of apertures.

12. The tension overload assembly of claim 10, wherein the first end is configured to be in communication with a support member and the second end is configured to be in communication with a fabric member.

13. The tension overload assembly of claim 12, wherein the fabric member is a net.

14. The tension overload assembly of claim 12, wherein the fabric member is configured to apply a load to the mechanical fuse link.

15. The tension overload assembly of claim 14, wherein in response to the load exceeding the predetermined design load, the reduced material portion is configured to fail.

16. The tension overload assembly of claim 12, further comprising a rescue cable configured to couple the support member to the fabric member separate from the mechanical fuse link.

17. A tension overload fuse assembly comprising:

a fuse link including a rigid member defining a reduced material portion, the fuse link configured to couple a fabric panel to a structural support, wherein the fuse link is configured to fail at the reduced material portion at a predetermined tension load, the predetermined tension load being less than a failure load of the structural support.

18. The tension overload fuse assembly of claim 17, wherein the reduced material portion includes at least one aperture.

19. The tension overload fuse assembly of claim 17, further comprising a rescue cable configured to couple the fabric panel to the structural support separate from the fuse link.

20. The tension overload fuse assembly of claim 19, wherein the predetermined tension load is less than a failure tension load of the rescue cable.

* * * * *